US006081927A

United States Patent [19]

Gimbel

[11] Patent Number: 6,081,927

[45] Date of Patent: Jul. 4, 2000

[54] PROTECTIVE GLOVE

[76] Inventor: Neal I. Gimbel, 5815 N. 25th St., Phoenix, Ariz. 85016

[21] Appl. No.: 09/320,420

[22] Filed: May 26, 1999

[51] Int. Cl.[7] ..... A41D 19/00

[52] U.S. Cl. ..... 2/161.7; 2/159; 2/167; 2/169

[58] Field of Search ..... 2/160, 159, 161.6, 2/161.7, 161.8, 164, 167, 168, 169

[56] References Cited

U.S. PATENT DOCUMENTS

| | | | |
|---|---|---|---|
| 5,428,841 | 7/1995 | Stein | 2/168 |
| 5,442,816 | 8/1995 | Seketa | 2/161.7 |
| 5,548,844 | 8/1996 | Ceresia | 2/161.7 |
| 5,568,657 | 10/1996 | Cordova et al. | 2/167 |
| 5,644,797 | 7/1997 | Daneshvar | 2/161.7 |

*Primary Examiner*—Diana Oleksa
*Assistant Examiner*—Katherine Moran
*Attorney, Agent, or Firm*—Tod R. Nissle, P.C.

[57] ABSTRACT

A method for fabricating a puncture resistant glove simplifies the manufacturing process and produces a glove which minimizes the likelihood that protective pads in the glove will absorb bodily fluids to contact the skin of a person wearing the glove.

6 Claims, 11 Drawing Sheets

FIG. 1
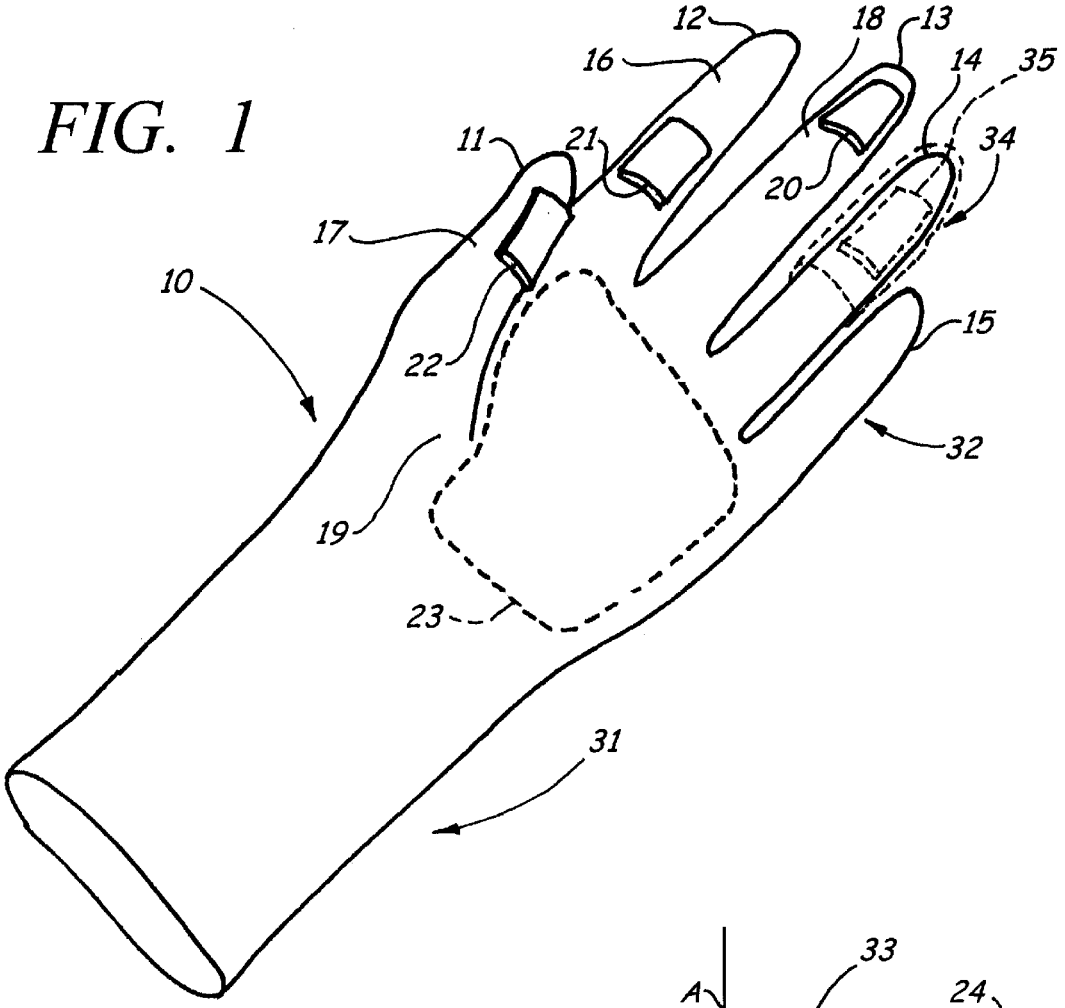
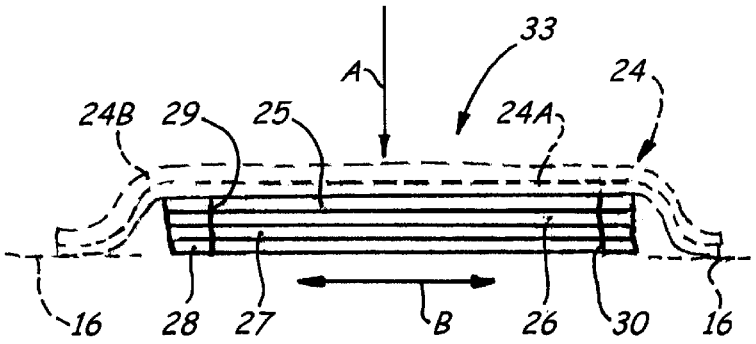
FIG. 2

FIG. 8
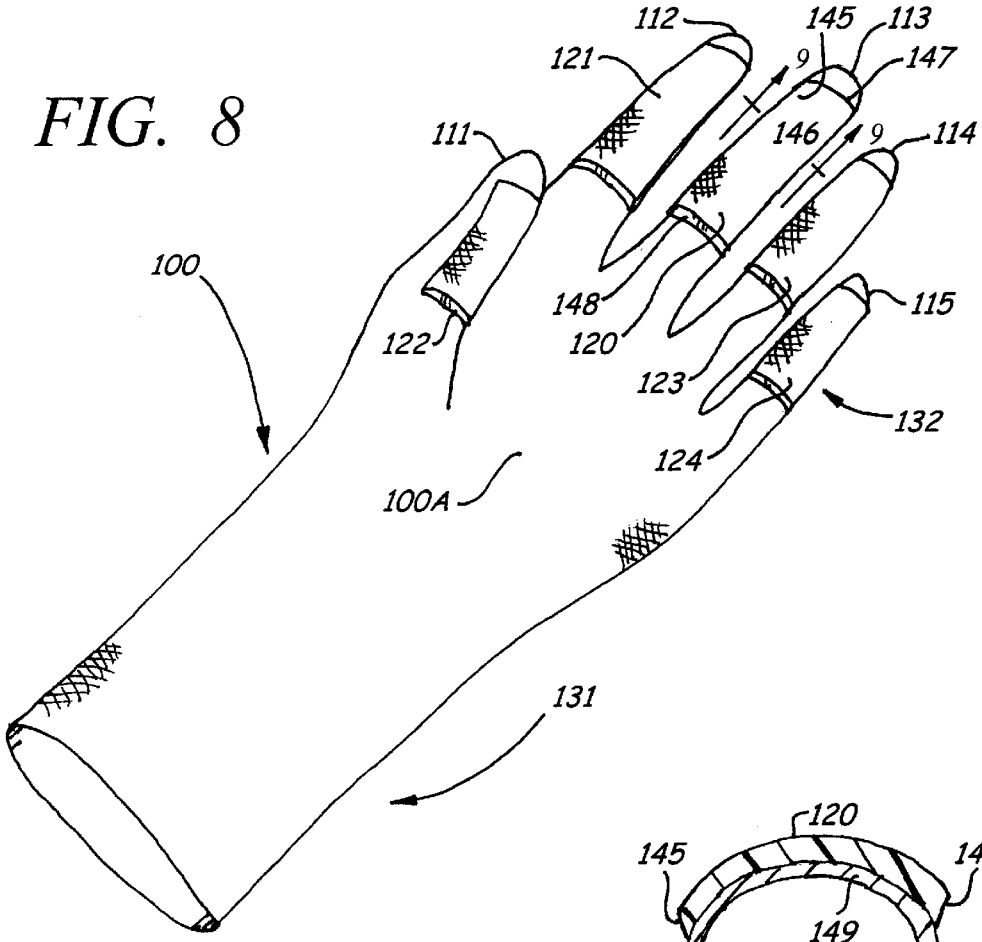
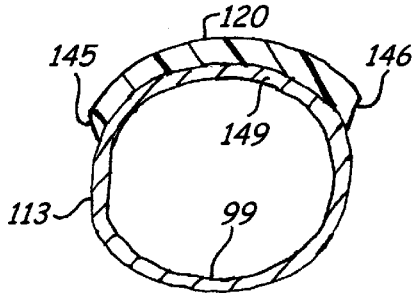
FIG. 9
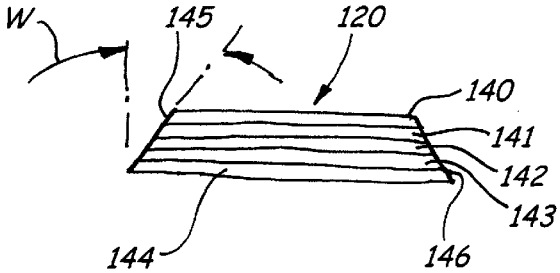
FIG. 10

FIG. 13
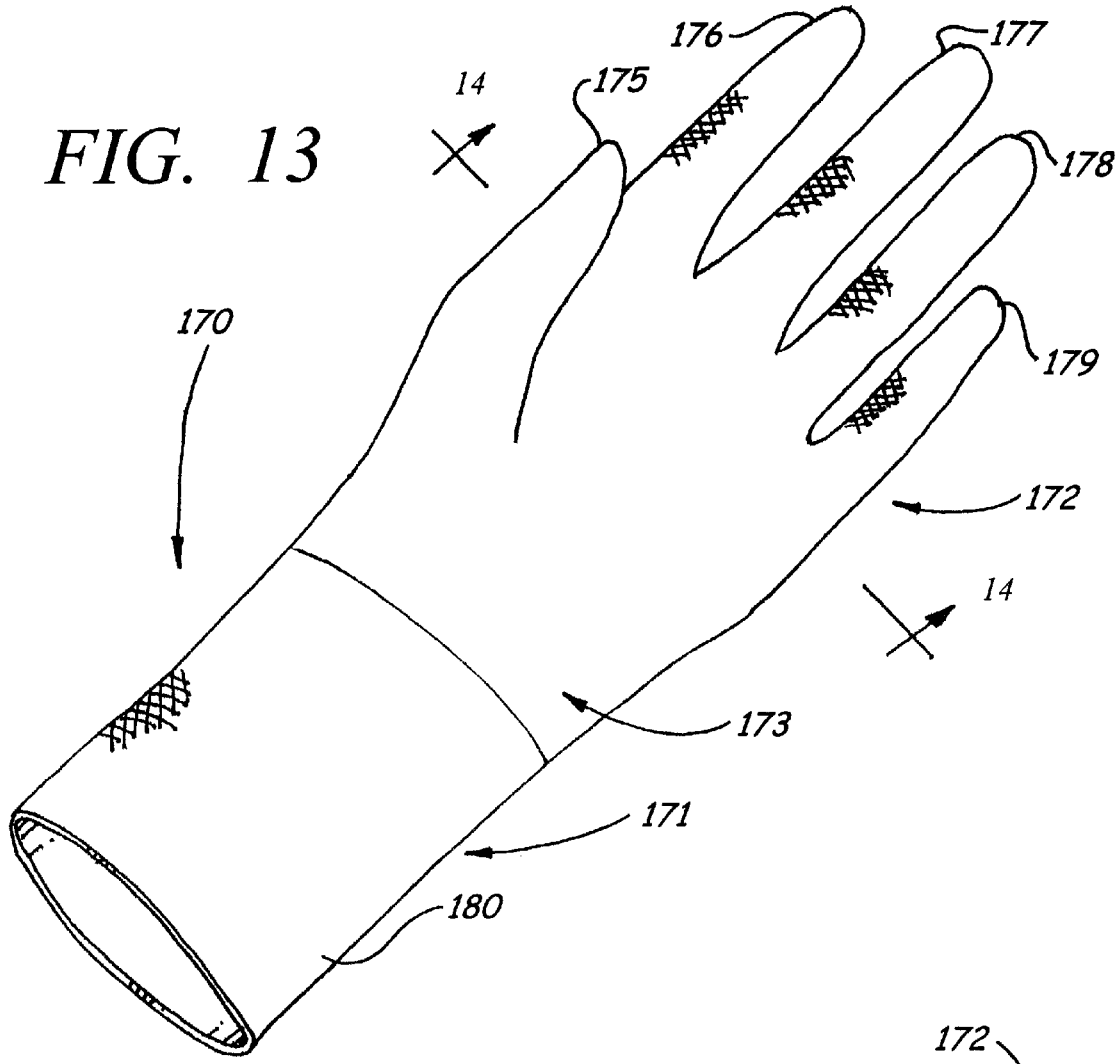
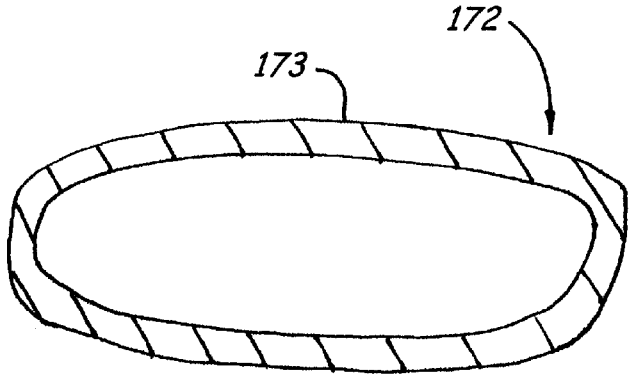
FIG. 14

PROTECTIVE GLOVE

This invention relates to gloves.

More particularly, the invention relates to a puncture resistant glove and method for making the same.

My U.S. Pat. No. 5,423,090 describes a method for making a puncture resistant glove. In the method, a puncture resistant pad is mounted on the tip of a fingerstall of a glove. A second supplemental fingerstall is obtained and is slipped over the puncture resistant pad and the fingerstall on which the pad is mounted. The glove is then dipped in latex to secure the supplemental fingerstall in place on the glove. While this method of manufacture successfully mounts a puncture resistant pad on a glove, the method can be labor intensive because of the additional steps of providing a supplemental fingerstall, of sliding the supplemental fingerstall in place on a glove, and of dipping the resulting "dual-stall" glove in latex to secure the supplemental fingerstall in place on the glove.

Accordingly, it would be highly desirable to provide an improved puncture resistant glove and method of manufacturing the same.

Therefore, it is a principal object of the invention to provide an improved puncture resistant glove.

Another object of the invention is to provide an improved method of manufacturing a puncture resistant glove.

These and other, further and more specific objects and advantages of the invention will be apparent to those skilled in the art from the following detailed description thereof, taken in conjunction with the drawings, in which:

FIG. 1 is a perspective view illustrating a glove constructed in accordance with the invention just prior to turning the glove inside out for packaging or for use on the hand of medical personnel;

FIG. 2 is a side view of a rectangular laminate woven fabric pad utilized in the glove of FIG. 1;

FIG. 8 is a perspective view illustrating a liner utilized in producing a puncture resistant glove in accordance with the invention;

FIG. 9 is a cross-sectional view of the glove of FIG. 8 taken along lines 9—9 and further illustrating construction details thereof;

FIG. 10 is an end elevation view of one of the puncture resistant pads utilized on the glove of FIG. 8 illustrating construction details of the pad;

FIG. 13 is a perspective view of still another liner used in the manufacture of a puncture resistant glove;

FIG. 14 is a cross-sectional view of the liner of FIG. 13 taken along lines 14—14 and further illustrating construction details thereof;

Figure 3:
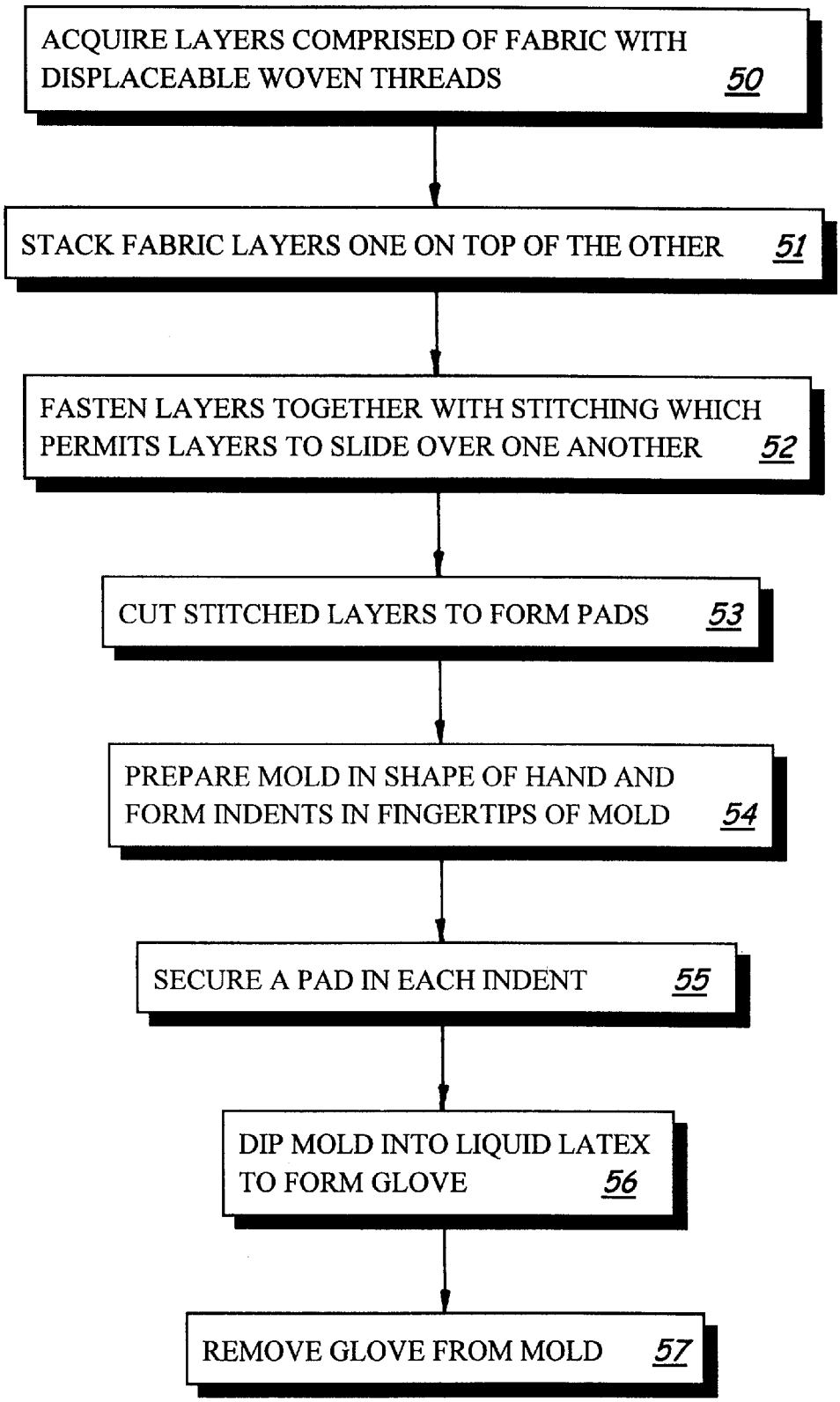
FIG. 3 is a block flow chart illustrating a method of making the puncture resistant glove of FIG. 1.

Briefly, in accordance with my invention, I provide improved puncture resistant handwear. The handwear includes a foundation glove composed of resilient elastic material having a lower hand covering potion, and a plurality of stalls connected to the covering portion and each for one of the digits of a hand and having a front portion and a rear portion. The front portion of each of the stalls is positioned over the volar surface of one of the digits when the glove is worn and has an inner surface adjacent the volar surface. The rear portion of each of the stalls is positioned over the dorsal surface of one of the digits when the glove is worn. The handwear also includes a puncture resistant pad on the inner surface of at least one of the stalls.

In another embodiment of my invention, I provide an improved method for manufacturing a puncture resistant handwear. The improved method includes the steps of stacking a plurality of woven fabric layers one on top of the other; securing the fabric layers together to form a unitary pad such that each layer can move with respect to an adjacent one of the layers; cutting the unitary pad to form a plurality of smaller layered pads each including a plurality of smaller layers of woven fabric, each of the smaller pads being secured together such that each of the smaller layers can move with respect to an adjacent one of the smaller layers; providing a hand-shaped mold; dipping the mold in liquid elastic material to form a glove; and, securing one of the smaller pads to the glove.

In a further embodiment of the invention, I provide a method for manufacturing a puncture resistant handwear. The method includes the steps of stacking a plurality of woven fabric layers one on top of the other; securing the plurality of fabric layers together to form a unitary pad such that each layer can move with respect to an adjacent one of the layers; cutting the unitary pad to form a plurality of smaller layered pads each including a plurality of smaller layers of woven fabric, each of the smaller pads being secured together such that each of the smaller layers can move with respect to an adjacent one of the smaller layers; providing a hand-shaped mold; mounting at least one of the smaller pads on the mold; and, dipping the mold in liquid elastic material to cover the smaller pad which is mounted on the mold and to form a glove.

In still another embodiment of the invention, I provide an improved method for manufacturing a puncture resistant handwear. The method includes the steps of providing a sock including a puncture resistant pad, and a thin elastic layer of material extending outwardly from the pad; of providing a hand-shaped mold including a plurality of digits; of pulling the sock over one of the digits; and, of dipping the mold in liquid elastic material to cover the sock and the mold to produce a glove.

In yet a further embodiment of the invention, I provide an improved method for manufacturing a puncture resistant handwear. The method comprises the steps of providing a glove—shaped liner including a puncture resistant front layer covering the palm and volar surfaces of a user's fingers when the liner is worn, and a thin elastic backing extending outwardly from the front layer; of providing a hand-shaped mold; of mounting the liner on the mold; and of dipping the mold in liquid elastic material to cover the liner to produce a glove.

In yet still another embodiment of the invention, I provide an improved method for manufacturing a puncture resistant handwear comprising the steps of providing a glove—shaped liner including a puncture resistant front layer covering the palm and volar surfaces of a user's fingers when the liner is worn, and a thin puncture resistant elastic backing extending outwardly from the front layer; providing a hand-shaped mold; mounting the liner on the mold; and, dipping the mold in liquid elastic material to cover the liner to produce a glove.

In a further embodiment of the invention, I provide an improved method for manufacturing a puncture resistant handwear. The method includes the steps of providing a glove—shaped liner including multiple puncture resistant layers co-extensive with the liner; of providing a hand-shaped mold; of mounting the liner on the mold; and, of dipping the mold in liquid elastic material to cover the liner to produce a glove.

Turning now to the drawings, which depict the presently preferred embodiments of the invention for purposes of illustrating the invention and not by way of limitation of the scope of the invention, and in which like characters refer to corresponding elements throughout the several views, FIG. 1 illustrates handwear 10 constructed in accordance with the principles of the invention and including a foundation glove have a lower hand covering portion 31 and an upper hand covering portion 32 connected to portion 31. Portion 32 includes a plurality of stalls 11 to 15. Each stall 11 to 15 has a front portion and a rear portion. The front portion of each of the stalls 11 to 15 is, when the foundation glove is worn on a hand, positioned over the volar surface of one of the digits. For example, stall 12 includes front portion 16 and stall 13 includes front portion 18. Stall 11 includes front portion 17. The rear portion of each of the stalls 11 to 15 is, when the foundation glove is worn on the hand, positioned over the dorsal surface of one of the digits of the hand. The palm area of handwear 10 is indicated by reference character 19.

The foundation glove of FIG. 1 is typically fabricated by forming or providing a mold in the shape of a human hand and by dipping the mold in heated liquid latex (or another desired liquid which dries to form a glove) at least once to form a latex coating on the mold. After the mold is withdrawn from the liquid latex, the coating dries to form a glove. After the coating dries, the glove is removed from the mold.

Puncture resistant pads 20 to 22 are secured to the outer surfaces of portions 18, 16, 17, respectively. Pads 20 to 22 can be secured to portions 18, 16, 17 by first spraying adhesive on the surfaces, or, any other desired fastening means or method can be utilized to mount pads 20 to 22 on surfaces 16 to 18. A larger pad can, as indicated by dashed lines 23, be affixed to the outer surface of palm area 19. After pads 20 to 22 are affixed to the foundation glove of FIG. 1, the glove is ordinarily, but not necessarily, pulled off the mold and turned inside out and is mounted on the hand of a user in the resulting inside-out orientation. Prior to removing the glove from the mold, the mold can be redipped one or more times. In fact, after any step in each of the glove making processes described herein, the mold can, if desired, be redipped one or more times to produce on the mold one or more additional layers of latex or other material.

Pads 20 to 22 can be fabricated from polyester, nylon, or any desired woven or non-woven material. A woven material is presently preferred in the invention because woven materials are, in comparison to many polymers, more readily made supple, puncture resistant in layers which can move with respect to one another. One example of woven material which can be utilized to fabricate pads 20 to 22 is obtainable from Burlington Industries, 1345A Avenue of the Americas, N.Y., N.Y. 10019, and has the specifications listed below:

Material: High-density interwoven nylon yarn

Style No.: 55116

Weight: 1.5 ounces per square yard

Thickness: Approximately three-thousands (3/1000) of an inch

Type of Weave: Plain

Warp: 30 denier nylon yarn, DuPont type 285, zero twist. 240 yarns per inch, 26 filaments per yarn.

Fill: 20 denier nylon yarn, DuPont type 285, zero twist 200 yarns per inch 7 filaments per yarn.

Color: White

Coating: None

The Burlington Industries material described above has a resistance to penetration by a needle which is three to five time greater than the resistance of latex rubber of the same thickness. The material can be doubled or tripled over so that the thickness is at least six one-thousandths of an inch, preferably at least nine one-thousandths of an inch. The doubling or tripling over of such material is known in the art.

Critical in the practice of the invention is the loose layering of fabric material. Loose layering is illustrated in FIG. 2 where layers 25 to 28 of woven fabric material are generally placed in registration one on top of the other and are then stitched 29, 30 or otherwise fastened together to form a puncture resistant pad 33. Pad 33 is then die cut or otherwise cut into smaller pads 20 to 22. Pad 33 is formed such that when pads 20 to 22 are cut from pad 33, the woven fabric layers in each pad 20 to 22 are fastened together by stitching and/or some other fastening means, such as by laser cutting the peripheral edges of the layers or by ultrasonically sealing the edges.

Stitching 29, 30 or other fastening procedures are, however, preferably, but not necessarily, carried out so that there is "play" in each layer 25 to 30 such that each layer can move laterally at least a short distance B with respect to adjacent layers. For example, in FIG. 2 layer 27 can be moved in the direction of arrows B while layers 26 and 28 are stationary. Layer 27 can slide over layers 26 and 28. The movement of layer 27 can be permitted because layer 27 is somewhat elastic and/or pliable, because there is slack in layer 27 intermediate stitching 29 and 30, or, because of any other desired method of fabricating pad 33. Similarly, in FIG. 2, each layer preferably can be displaced at least a short distance up or down in directions normal to the arrows B.

The movement of layers 25 to 28 in pad 33 (and in smaller pads cut from pad 33) is believed critical for the following reasons. First, when a needle penetrates a layer 25, the tip of the needle frictionally engages and pushes apart threads comprising the layer. When the threads are pushed apart, they often tend to attempt to return elastically or otherwise to their "pre-needle" orientation. This causes the threads to squeeze the needle and increase the frictional contact between the threads and the tip of the needle.

When the tip of the needle (or of a scalpel or other sharp instrument) penetrates a layer 25, it typically passes through an interstitial opening in layer 25. When the needle tip begins penetrating the next adjacent layer 26, the needle tip looks for the path of least resistance. The path of least resistance ordinarily is through an interstitial opening in the woven fabric in layer 26. Since, however, each interstitial opening in one layer is not aligned with an adjacent interstitial opening in an adjacent layer, the needle tip tends to contact a thread in the next adjacent layer 26. The needle tip also, however, tends to "sluff or slide off" the thread into an interstitial opening in layer 26. When the needle tip slides off the thread in layer 26, the tip tends to laterally displace both the thread and at least a portion of layer 26 adjacent the displaced thread such that the interstitial opening in layer 26 aligns with the interstitial opening that the needle tip passed through in layer 25. The afore-mentioned lateral displacement of the portion of layer 26 of the next adjacent layer tends to generate additional frictional forces on the needle tip because layer 26 tends to pull on the needle when layer 26 attempts to return to the position it occupied before being displaced by the needle tip. When the needle tip has to penetrate four or more layers of fabric in a pad 20 to 23, the frictional forces so generated can become significant and, in effect, engage and "lock" the needle tip and prevent it from moving further through pad 20 to 23. Therefore, a pad including a plurality of stacked, adjacent, pliable, interconnected, contacting displaceable woven fabric layers is preferred, but not required, in the practice of the invention. It is also preferred that a pad 20 to 23 be pliable so that it can conform to a fingertip of a hand which contacts the pad.

Pad 33 in FIG. 2 can, after the layers 25 to 28 are stitched together or otherwise interconnected, be cut into smaller pads 20 to 22.

A pad 33 (or 20 to 23) can, if desired, include an additional layer 24 which includes a layer 24B of fabric or other material and a layer 24A of pressure sensitive adhesive or other adhesive. The adhesive in the central portion of layer 24A secures layer 24B to the top layer 25 of pad 33. Adhesive on the peripheral portion of layer 24A can be pressed against the outer surface 16 of the digit 12 of a glove to secure layer 24A and pad 33 to digit 12. Layer 24 can extend across only a portion of a pad 33, 20 to 23 or can completely cover and envelop a pad 33 after the peripheral edge of layer 24 is secured to the outer surface 16 of a glove 10 in the manner illustrated in FIG. 2. After a layer 24 and pad 33 are affixed to a surface 16 of a glove 10 in the manner illustrated in FIG. 2, the mold (and glove 10 on the mold) can, if desired, be redipped to coat (preferably, but not necessarily, completely coat) layer 24.

The handwear fabrication method described in FIG. 3 includes the steps of acquiring layers comprised of fabric with displaceable woven threads 50, stacking fabric layers one on top of the other 51, fastening layers together with stitching (or other fastening means) which permits the layers to slide over one another 52, and cutting the stitched together layers to form pads 53. In step 54 a mold is prepared in the shape of a hand and indents are formed in the fingertips or other desired portion(s) of the mold. The indent opens onto the surface of the mold. Then, in step 55, a pad 20 to 22 is mounted in each indent, followed by dipping 56 the mold into liquid latex. The latex forms a film over the surface of the mold, including over the pad 20 to 22 in the indent formed in the surface of the mold.

After the latex dries, it engages and/or adheres to pad 20 to 22 such that pad 20 to 22 is positioned on the inside of the glove after the glove is removed 57 from the mold. When the glove is removed from the mold it is not turned inside out with respect to the position of the glove on the mold. E.g., when the glove is removed from the mold, the portion of the glove which contact the mold and was on the inside of the glove remains on the inside of the glove. The mold utilized in the method of FIG. 3, or in any of the other glove producing methods described herein, can have any desired shape and dimension. For example, indents can be formed in the digits of the molds to receive and hold puncture resistant pads, or, the fingertip portions of the mold can be flattened to facilitate placement of puncture resistant pads on the mold or on a glove which is on the mold and is formed by dipping the mold in a bath of liquid latex.

Figure 4:
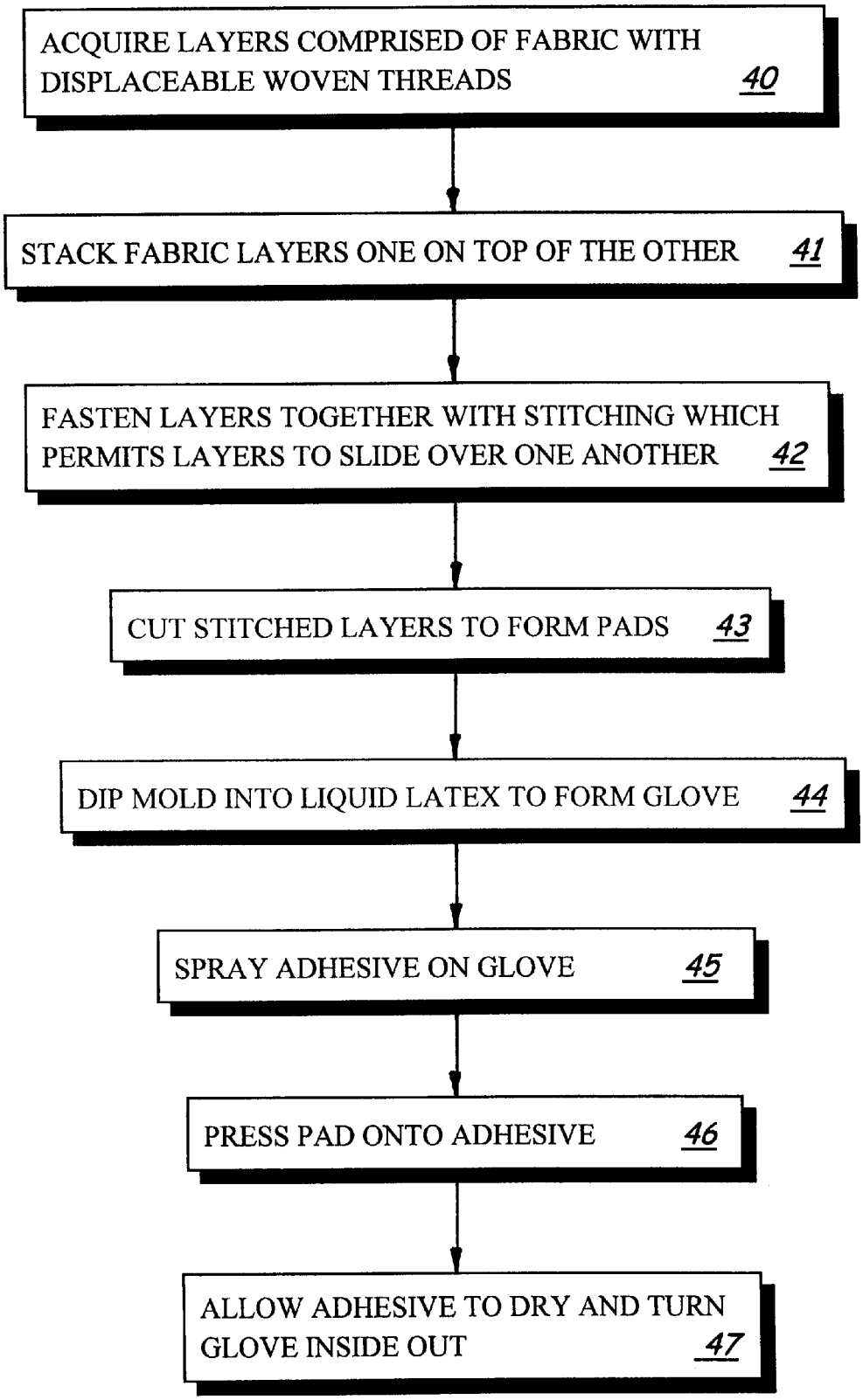
FIG. 4 is a block flow chart illustrating another method of making a puncture resistant glove.

In the method of FIG. 4, steps 40 to 43 are identical to steps 50 to 53. In step 44 a mold in the shape of a hand of a person is dipped 44 in latex to form a latex film on the mold. The film is allowed to dry. Adhesive is, while the glove remains on the mold, sprayed on surfaces 18, 16, 17 (FIG. 1) and pads 20 to 22 are pressed onto surfaces 18, 16, 17, respectively. The adhesive dries and fixes pads 20 to 22 on stalls 13 to 11 in the manner shown in FIG. 1. The glove is then turned inside out by pulling it off the mold.

When the glove is pulled off the mold, if the glove is left handed while on the mold, it becomes right handed (and vice versa) when pulled off the mold. A pad 22 to 22 which is on a surface 18, 16, 17 when the glove is on the mold ends up (after the glove is pulled off the mold) on the inside of a finger stall on the portion of the stall which is over and contacts the fingerprint side of a user's finger when the user inserts his hand in the glove.

The fabric utilized to make pad 33 and smaller pads 20 to 22 can be hydrophobic and resists wetting by blood and other aqueous bodily fluids. This additional safety measure can be important in the event the portion of the handwear 10 adjacent a pad 20 to 22 is cut and permits a pad 20 to 22 to be contacted by the blood or another bodily fluid of a patient being treated by the medical attendant wearing the glove. Hydrophobic pads help prevent a pad 20 to 22 from absorbing like a sponge a bodily fluid which can then, when the pad contacts the hand of a person wearing the handwear, also contact the person's hand. It is also preferred that woven fabric or other pads 20 to 22 be constructed in a way which minimizes or eliminates capillary action. Eliminating capillary action makes it more difficult for a pad 20 to 22 to be wet by a bodily fluid. If desired, however, the fabric utilized to make pad 33 and smaller pads 20 to 22 can be hydrophillic to facilitate the absorption of moisture and bonding of latex to the pads when the latex is either liquid or is in a gel-like partially solidified state.

In one embodiment of the invention, at least the outer layer (24 or 28 as the case may be) which will, when the handwear is worn by a user, directly contact skin on a finger of the user is made of a fabric or other material which is hydrophobic and which minimizes or eliminates capillary action.

Fabricating pads 20 to 22 to prevent or minimize the absorption of bodily fluids is an important safety feature incorporated in the invention.

As can be seen with respect to FIGS. 3 and 4, it is presently preferred that pads 20 and 22 be positioned inside handwear such that pads 20 to 22 contour to, conform to, directly contact, and ride on the fingertips of the hand of a user wearing the handwear.

Figure 5:
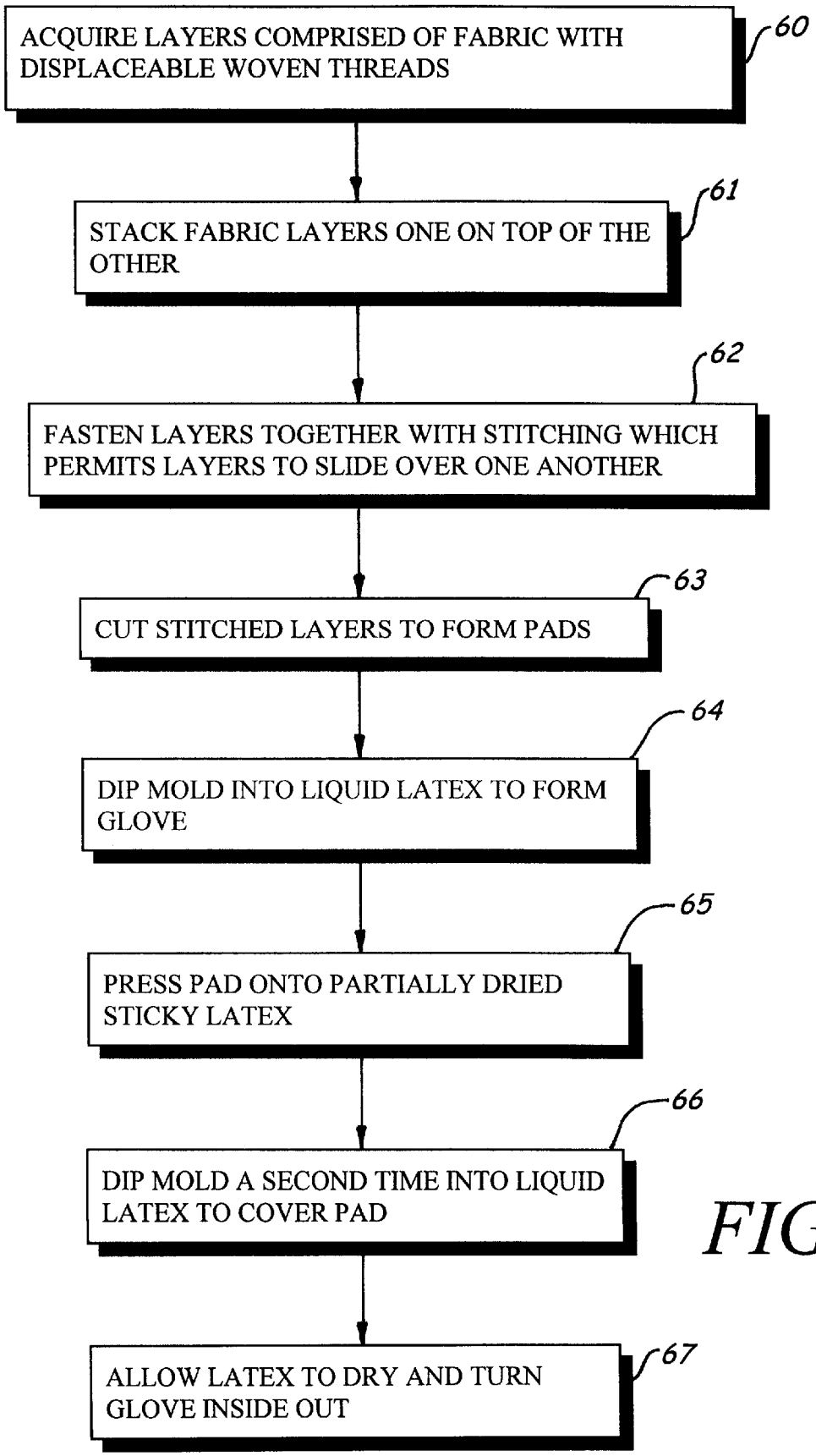
FIG. 5 is a block flow chart illustrating another method of producing a puncture resistant glove.

The embodiment of the invention illustrated in FIG. 5, includes the steps of acquiring fabric layers comprised of displaceable woven threads 60; of stacking fabric layers one on top of the other 61; of fastening the fabric layers together with stitching (or with other fastening means) to form a laminate such that portions of each laminate layer can slide over opposing portions of immediately adjacent layers 62; of cutting the stitched together laminate to form pads 63; of dipping a hand-shaped mold into a liquid latex bath to form a layer of latex on the mold (i.e., to form a latex glove on the mold) 64; of, within about five to fifteen seconds after the mold is pulled up out of the latex bath, pressing a pad on at least one of the fingertips (or other area) of the partially dried sticky latex layer on the mold 65; of dipping the mold a second time into the liquid latex bath to cover and coat the pad with a layer of latex 66; and, after the mold is withdrawn from the latex bath, of allowing the latex to dry on the mold 67. After the latex drys, the resulting latex glove is pulled off the mold. When the glove is pulled off the mold, the glove typically turns inside out.

In step 65, the pads can be pressed on manually or with a machine. When the pads are pressed on manually, the pads typically must be quickly placed on each finger before the latex dries and sets up. The latex typically sets up within five to fifteen seconds.

Figure 6:
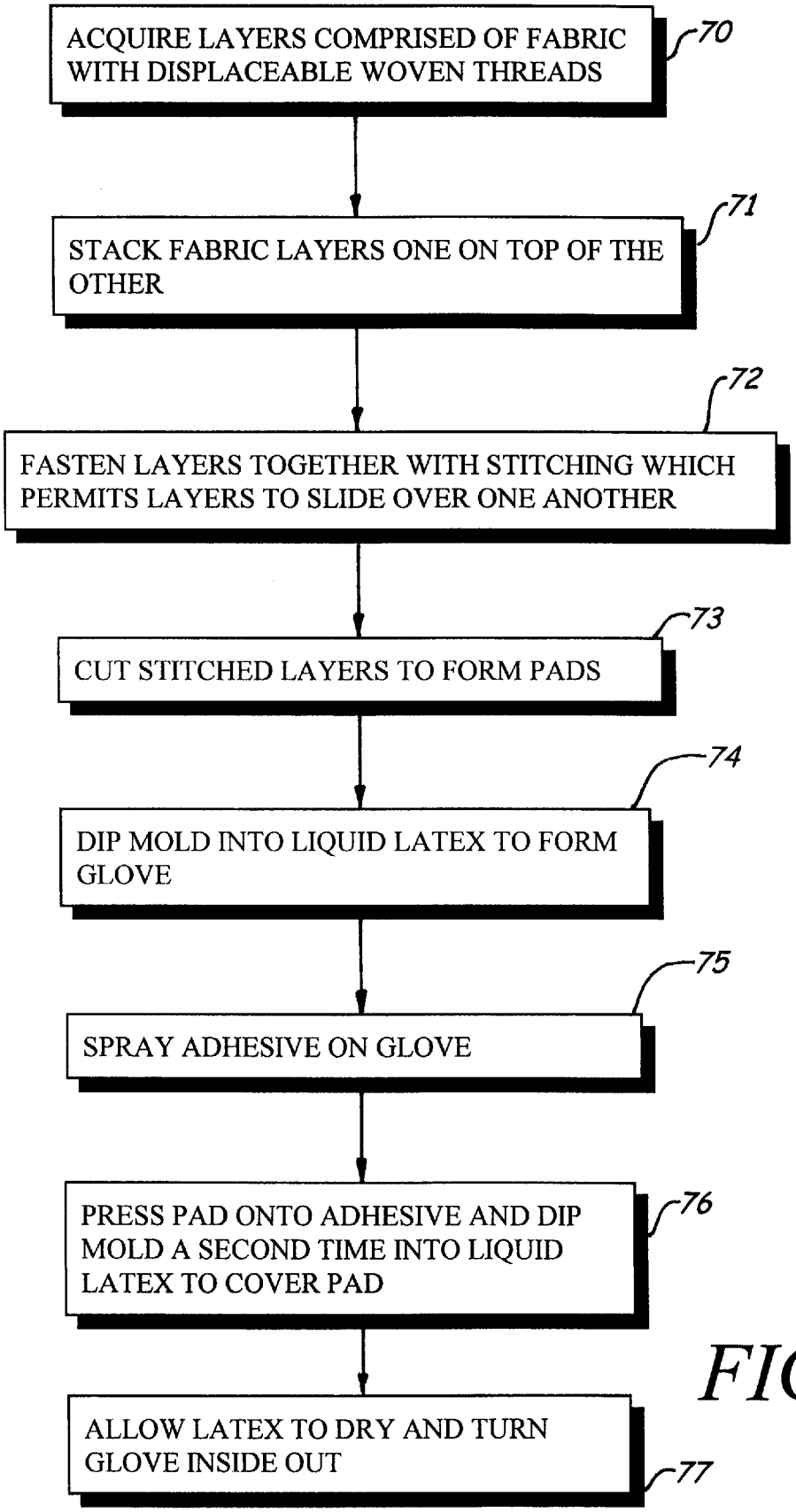
FIG. 6 is a block flow chart illustrating a further method of producing a puncture resistant glove.

The method of the invention set forth in FIG. 6 includes the steps of acquiring fabric layers comprised of displaceable woven threads 70; of stacking the fabric layers one on top of the other 71; of fastening the stacked fabric layers together with stitching (or other fastening means) such that portions of each layer can slide over portions of adjacent fabric layers 72; of cutting the stitched layers to form pads 73; of dipping a hand-shaped mold into a liquid latex bath to form a layer of latex (i.e., to form a latex glove) on the mold 74; of, after the mold is pulled out of the latex bath, spraying or otherwise applying adhesive on the glove 75; of pressing a pad onto the adhesive on at least one fingertip (or other area) of the glove and dipping the mold a second time into the liquid latex bath 76 to coat the pad with latex; and, after the mold is withdrawn from the latex bath, of allowing the latex on the mold to dry and turning the glove inside out by pulling the glove off the mold.

Figure 7:
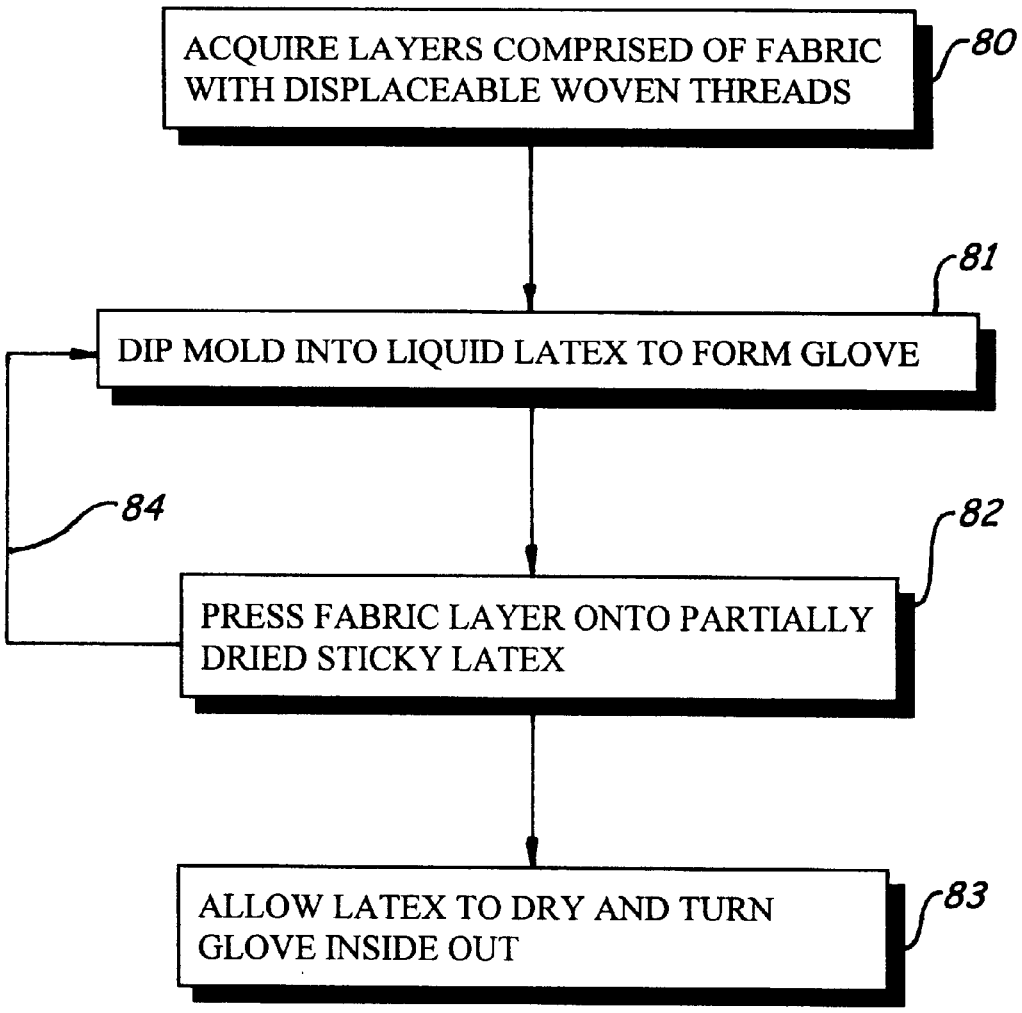
FIG. 7 is a block flow chart illustrating still another method of producing a puncture resistant glove.

The method of FIG. 7 includes the steps of acquiring fabric layers or pads comprised of displaceable woven fabric threads 80; of dipping a hand-shaped mold into liquid latex to form a layer of latex on the mold (i.e., to form a glove) 81; of, after the mold is withdrawn from the latex bath, pressing (or gluing) one or more fabric layers onto the fingertip (or other area) of the partially (or completely) dried latex layer on the mold 82; of repeating 84 steps 81 and 82 as many times as desired to form alternating layers of fabric and latex on the fingertips (or other areas) of the glove; and, of withdrawing the mold from the latex bath for the final time, letting the latex on the mold dry, and turning the glove inside out by pulling the glove off the mold 83. The method of the invention set forth in FIG. 7 becomes more practical when equipment is utilized which automatically mechanically presses fabric layers onto the fingertips of a partially dried latex (or other material) glove as soon as the glove is withdrawn from the liquid latex bath. An alternative to step 82 is to spray or otherwise apply an adhesive to the latex on the mold and to then press the fabric layer on to the adhesive. Also, if desired, the glove need not be turned inside-out when it is removed from the mold.

When in the method of FIG. 7 woven fabric layers are alternated with latex layers, each woven fabric layer is preferably in a different orientation with respect to others of the alternating woven fabric layers. For example, if the woven threads in each fabric layer form a checkerboard pattern, then the checkerboard pattern in one layer is preferably not in registration with the checkerboard pattern in an adjacent layer but is instead rotated about a reference axis by 10 degrees, 20 degrees, 30 degrees, etc. (and not by 90 degrees) such that the patterns in the two adjacent layer are not in registration and are at an angle with respect to one another. The reference axis is normal to planes in each woven fabric layer. These planes each extend across the bottom or top surface of the fabric layer. Altering the orientation of each woven fabric layer with respect to adjacent fabric layers typically improves the collective puncture resistant of the fabric layers.

FIGS. 8 to 10 illustrate a glove liner 100 including a glove shaped-member fabricated from thin elastic material fabricated from cotton, polyester or so other material; and, including a plurality of multi-layer fabric puncture resistant pads 121 to 124 of the general type illustrated in FIG. 2 or FIG. 10. The glove-shaped member includes a lower hand covering portion 131 and an upper hand covering portion 132 connected to portion 131.

Pads 121 to 124 or any other puncture resistant pads described herein can be fabricated out of any desired material and include one or more layers. Presently, however, a pad has a general preferred construction comparable to the pad 120 illustrated in FIG. 10. Rectangular pad 120 includes woven fabric layers 140 to 144. Layers 140 to 144 are sealed along parallel opposed canted edges 145 and 146 with ultrasonic bonding. Parallel opposed spaced apart ends 147 and 148 can also be ultrasonically or otherwise sealed such that the entire periphery or edge of pad 120 is sealed. Pad 120 can also, if desired, be stitched together at selected points in the manner that pad 33 is stitched together in FIG. 2.

Portion 132 includes a plurality of stalls 111 to 115. Each stall 111 to 115 has a front portion and a rear portion. The front portion of each stall 111 to 115 is, when the foundation glove is worn on a hand, positioned over the volar surface of one of the digits. For example, stall 113 includes front portion 149 and stall 113 includes rear portion 99. Stall 11 includes front portion 17. The rear portion of each of the stalls 111 to 115 is, when the foundation glove is worn on the hand, positioned over the dorsal surface of one of the digits of the hand. The palm area of handwear 100 is indicated by reference character 100A.

Puncture resistant pads 120 to 124 are secured to the front portions of stalls 111 to 115. Pads 120 to 124 can be secured to stalls 11 to 115 by first spraying adhesive on the surfaces, or, any other desired fastening means or method can be utilized to mount pads 120 to 124 on the front portions of stalls 111 to 115. A larger pad can, if desired, be affixed to the outer surface of palm area 100A.

Edges 145, 146 are each tapered or "feathered" to facilitate conforming of pad 120 to the stall 113. The angle, indicated by arrows W in FIG. 10, between a vertical line and canted edge 145 is in the range of 5 to 75 degrees, and is presently preferably about sixty degrees.

Pads 120 to 124 need not be mounted on stalls 111 to 115 by mounting the pads 120 to 124 on top of a liner 100. The thin elastic cotton material can instead be attached to and extend outwardly from the edges of each pad 120 to 124. In this scenario, the thin cotton elastic material does not extend underneath each pad 120 to 124 in the manner illustrated in FIG. 9. Instead, each pad 120 to 124 is integrated in the thin elastic cotton material such that the cotton material extends outwardly from the periphery of each pad 120 to 124.

Figure 11:
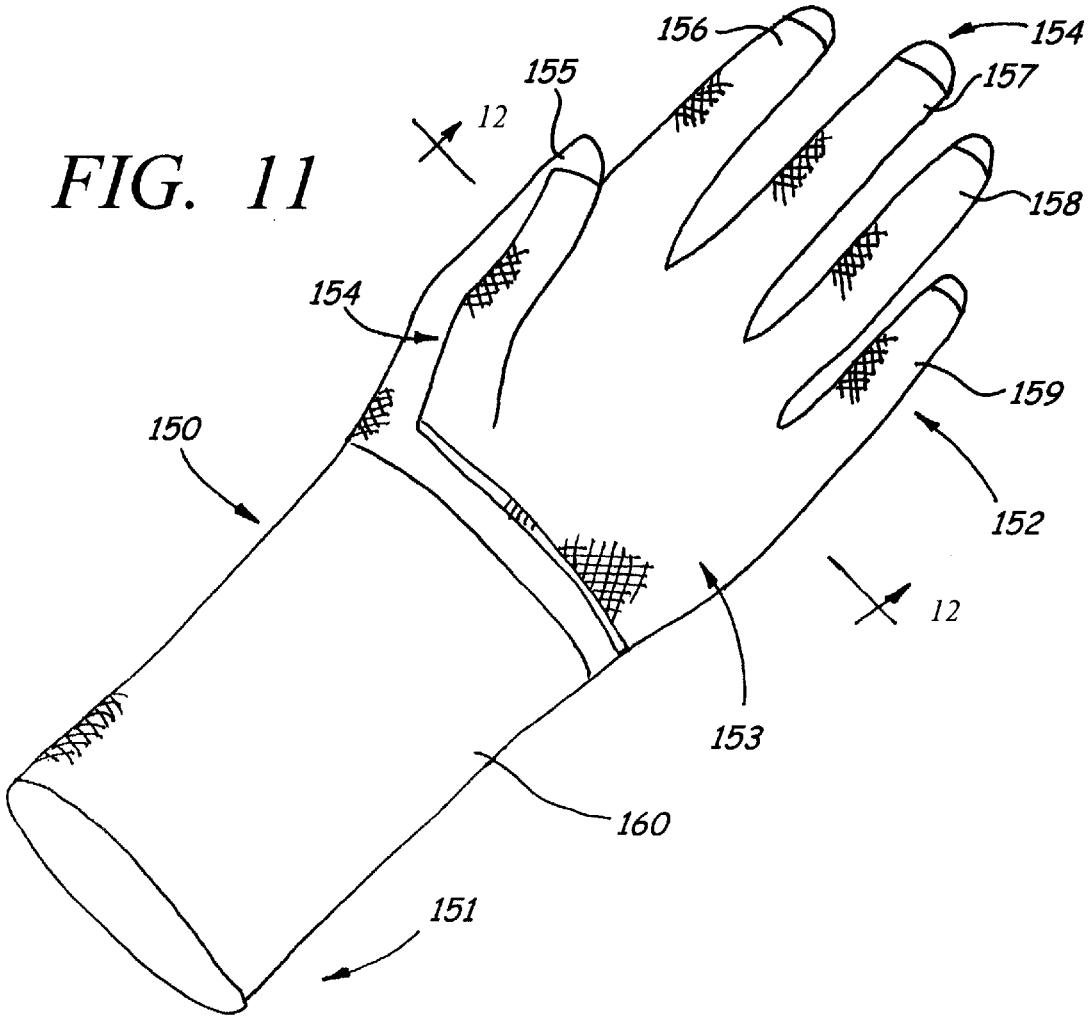
FIG. 11 is a perspective view of another liner used in the manufacture of a puncture resistant glove.
Figure 12:
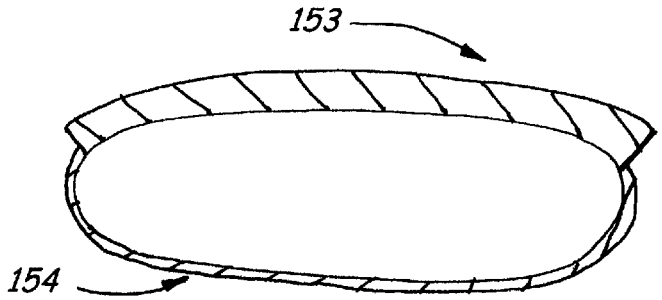
FIG. 12 is a cross-sectional view of the liner of FIG. 11 taken along lines 12—12 and further illustrating construction details thereof.

FIGS. 11 and 12 illustrate a glove liner 150 having finger stalls 155 to 159 and including lower hand covering portion 151 and upper hand covering portion 152. Liner 150 includes a member 154 fabricated from thin elastic cotton material and includes a puncture resistant palm—inner finger member 153. Member 153 can be fabricated from any desired material and can comprise one or more layers of material, but is presently fabricated of a laminate comprised of generally co-extensive layers of woven fabric material. The layers are interconnected such that at least one portion of each layer can move and slide over a portion of an adjacent layer. While any desired method can be utilized to fasten together the layers of woven fabric material, the stitching or ultrasonic welding or bonding discussed earlier are presently preferred. Member 153 extends over the palm and inner finger surface when liner 150 is worn on a user's hand. As shown in FIG. 12, thin elastic cotton member 154 is attached to and extends outwardly from the peripheral edge of member 153. Wrist cuff 160 is attached to member 154 and is presently preferably fabricated from nylon.

FIGS. 13 and 14 illustrate a glove liner 170 having finger stalls 175 to 179 and including lower hand covering portion 171 and upper hand covering portion 172. Liner 170 includes a glove-shaped member 173 which covers the hand of a user. Member 173 can be fabricated from any desired material and can comprise one or more layers of material, but is presently fabricated from a laminate comprised of generally co-extensive layers of woven fabric material. The layers are interconnected such that at least one portion of each layer can move and slide over a portion of an adjacent layer. While any desired method can be utilized to fasten together the layers of woven fabric material, the stitching or ultrasonic welding or bonding discussed earlier are presently preferred. When worn, glove member 173 circumscribes and covers a user's hand. Wrist cuff 180 is attached to member 173 and is presently preferably fabricated from nylon.

Figure 15:
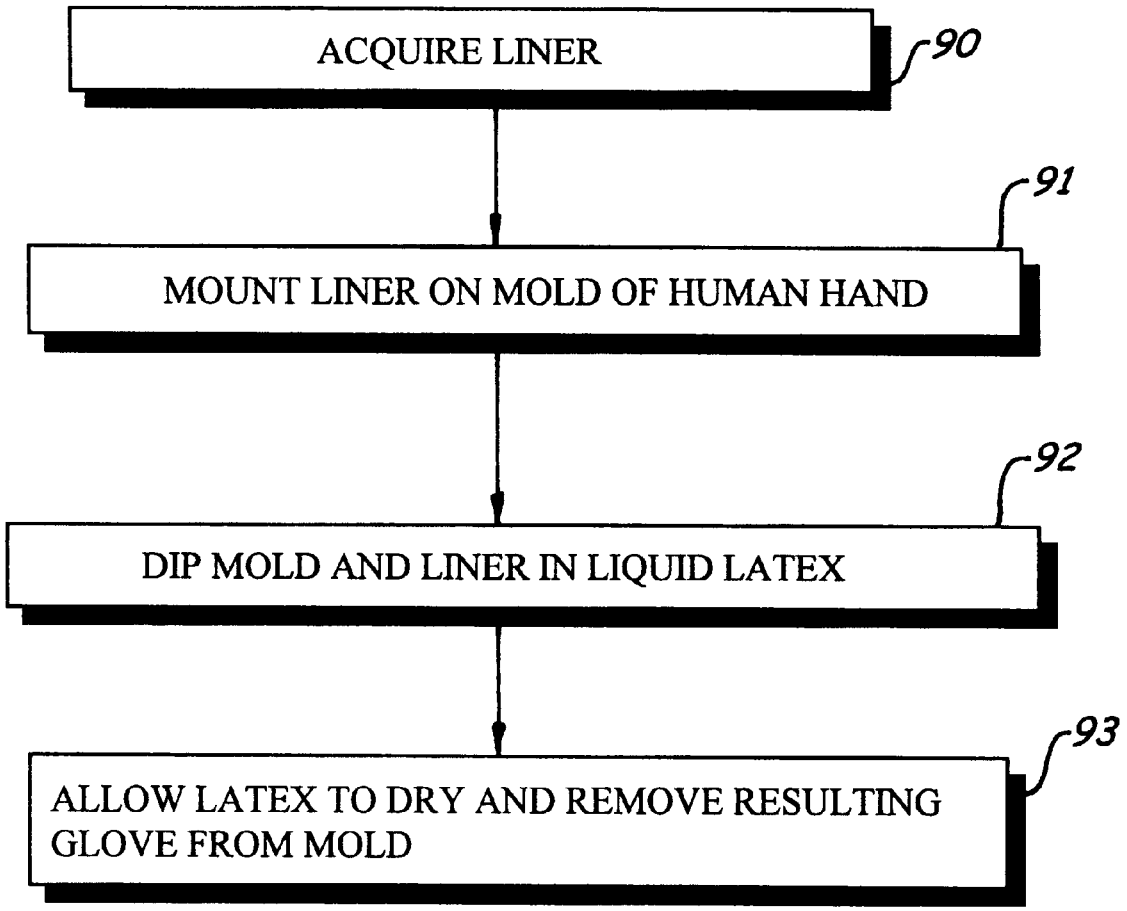
FIG. 15 is a block flow diagram illustrating a method of producing a puncture resistant glove using a liner; and, FIG. 16 is a block flow diagram illustrating another method of producing a puncture resistant glove using a liner.

FIG. 15 illustrates one method of utilizing a liner 100, 150, 170. In step 90 a liner 100, 150, 170 is acquired. In step 91, the liner is mounted on a mold. The mold is shaped like a human hand. The liner is mounted on the mold in the same manner that a glove is pulled and mounted on the hand of a user. In step 92, the mold (and liner mounted on the mold) are dipped in a bath of liquid latex. After the mold is withdrawn from the bath, the latex is allow to dry and the glove is removed from the mold 93. If desired, the mold can be dipped in the latex bath more than once.

Figure 16:
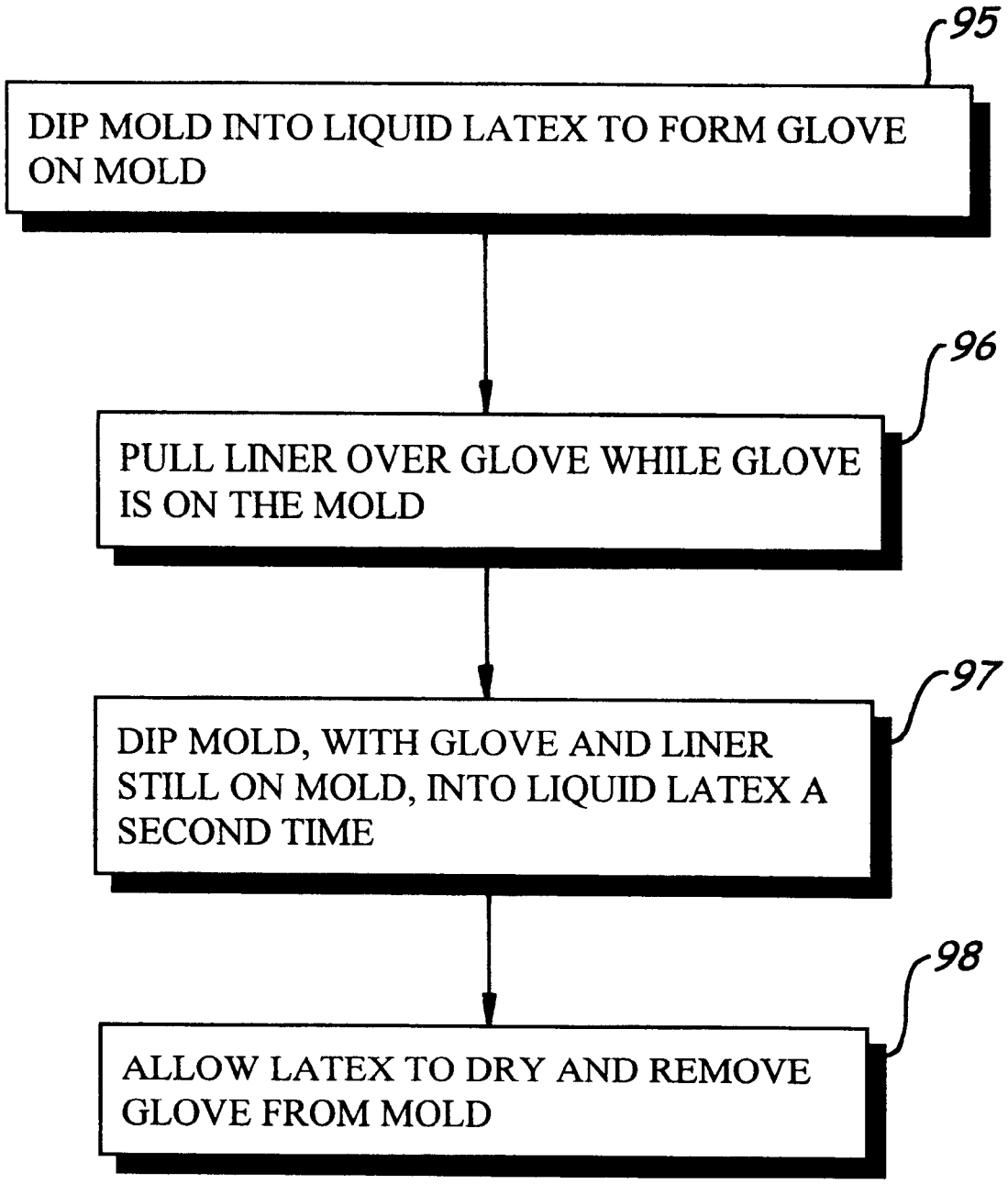

FIG. 16 illustrates another method of utilizing a liner 100, 150, 170. In step 95 a hand-shaped mold is dipped into a liquid latex bath to coat the mold and form a glove on the mold. After the mold is withdrawn from the liquid latex bath, the latex preferably is permitted at least partially to dry. In step 96, a liner 100, 150, 170 is pulled over the mold (and the coating of latex on the mold). In step 97, the mold, with the glove and liner on the mold, is dipped a second time into the liquid latex bath. After the mold is withdrawn from the liquid latex bath, the latex is allowed to dry and the resulting glove is removed from the mold. Before the liner is mounted on the mold, the mold can be dipped in the liquid latex bath as many times as desired. After the liner is mounted on the mold, the mold can be dipped in the liquid latex bath as many times as desired.

While the various embodiments of the puncture resistant glove of the invention are described herein as being manufactured utilizing a liquid latex bath, it is understood that (1) a liquid bath of any other desired material can be utilized in place of or in conjunction with a liquid latex bath, and (2) latex or any other desired material can be applied in a liquid or solid form to a mold to coat the mold (or a liner, pad, etc.) by using spraying equipment, heat shrinking equipment, or any other desired apparatus.

In another embodiment of the invention, a pad or layer of material 35 (FIG. 1) is placed or secured on a digit 14 of a glove 10 that is on a mold and is covered with a sock 34. The mold (and glove 10 on the mold) is dipped is a liquid latex bath to coat completely the sock 34 and digit 14 to seal sock 34 in place on digit 14. Sock 34 can be fabricated from thin cotton elastomer, from nylon, or from any other desired material. A pad 20 to 22, 35 can be secured to a glove 10 with an adhesive, by pressing the pad on glove while glove 10 is still wet and sticky after the mold bearing glove 10 has been dipped in a latex bath or by any other desired method.

Having described my invention in such terms as to enable those skilled in the art to understand and practice it, and having identified the presently preferred embodiments thereof, I claim:

1. A method for manufacturing a puncture resistant handwear comprising the steps of:

(a) stacking a plurality of woven fabric layers one on top of the other;

(b) fastening said plurality of fabric layers together to form a unitary pad such that each layer can move with respect to an adjacent one of said layers, (c) cutting said unitary pad to form a plurality of smaller layered pads each including a plurality of smaller layers of woven fabric, each of said smaller pads being fastened together such that each of said smaller layers can move with respect to an adjacent one of said smaller layers;

(d) providing a hand-shaped mold;

(e) dipping said mold in liquid elastic material to form a glove; and, (f) securing one of said smaller pads to said glove.

2. A method for manufacturing a puncture resistant handwear comprising the steps of:

(a) stacking a plurality of woven fabric layers one on top of the other;

(b) fastening said plurality of fabric layers together to form a unitary pad such that each layer can move with respect to an adjacent one of said layers;

(c) cutting said unitary pad to form a plurality of smaller layered pads each including a plurality of smaller layers of woven fabric, each of said smaller pads being fastened together such that each of said smaller layers can move with respect to an adjacent one of said smaller layers;

(d) providing a hand-shaped mold;

(e) mounting at least one of said smaller pads on said mold; and, (f) dipping said mold in liquid elastic material to cover said one of said smaller pads and form a glove.

3. A method for manufacturing a puncture resistant handwear comprising the steps of:

(a) providing a sock including (i) a puncture resistant pad, and (ii) a thin least layer of material extending outwardly from said pad;

(b) providing a hand-shaped mold including a plurality of digits;

(c) pulling said sock over one of said digits; and, (d) dipping said mold in liquid elastic material to cover said sock, said pad, and said mold to produce a glove.

4. A method for manufacturing a puncture resistant handwear comprising the steps of:

(a) providing a glove—shaped liner including (i) a puncture resistant front layer covering the palm and volar surfaces of a user's fingers when the liner is worn, and (ii) a thin elastic backing extending outwardly from said front layer;

(b) providing a hand-shaped mold;

(c) mounting said liner on said mold; and (d) dipping said mold in liquid elastic material to cover said liner to produce a glove.

5. A method for manufacturing a puncture resistant handwear comprising the steps of (a) providing a glove—shaped liner including (i) a puncture resistant front layer covering the palm and volar surfaces of a user's fingers when the liner is worn, and (ii) a thin puncture resistant elastic backing extending outwardly from said front layer;

(b) providing a hand-shaped mold;

(c) mounting said liner on said mold; and (d) dipping said mold in liquid elastic material to cover said liner to produce a glove.

6. A method for manufacturing a puncture resistant hand-wear comprising the steps of (a) providing a glove—shaped liner including multiple puncture resistant layers co-extensive with said liner;

(b) providing a hand-shaped mold;

(c) mounting said liner on said mold; and (d) dipping said mold in liquid elastic material to cover said liner to produce a glove.

* * * * *